US007566839B2

(12) United States Patent
Hukuba et al.

(10) Patent No.: US 7,566,839 B2
(45) Date of Patent: Jul. 28, 2009

(54) CONTACT-BREAKER DEVICE, CIRCUIT AND APPARATUS COMPRISING THE SAME, AND METHOD FOR ASSEMBLING CONTACT-BREAKER DEVICE

(75) Inventors: Hiroshi Hukuba, Nagareyama (JP); Akira Ikegami, Nagareyama (JP); Keisabro Tozawa, Nagareyama (JP); Yukito Kohno, Nagareyama (JP); Kimihiro Saeki, Nagareyama (JP); Akiko Saeki, legal representative, Nagareyama (JP); Satoshi Saeki, legal representative, Nagareyama (JP); Tomoko Shibata, legal representative, Sidney, OH (US); Kiyoshi Kobayashi, Nagareyama (JP); Toshio Tobe, Nagareyama (JP); Kiyoshi Ikegami, Nagareyama (JP)

(73) Assignee: Hukuba Dental Kabushiki Kaisha, Nagareyama-shi (JP)

( * ) Notice: Subject to any disclaimer, the term of this patent is extended or adjusted under 35 U.S.C. 154(b) by 689 days.

(21) Appl. No.: 11/139,023

(22) Filed: May 27, 2005

(65) Prior Publication Data

US 2006/0028306 A1 Feb. 9, 2006

(30) Foreign Application Priority Data

May 28, 2004 (JP) ..... 2004-158562
Mar. 24, 2005 (JP) ..... 2005-086770

(51) Int. Cl.
*H01H 35/14* (2006.01)

(52) U.S. Cl. ..... 200/61.45 R

(58) Field of Classification Search 200/61.45 R–61.53 R, 600; 362/103, 228, 251, 84, 802; 36/137; 15/23, 167, 105; 307/112–122, 125, 132 R, 307/132 V, 139
See application file for complete search history.

(56) References Cited

U.S. PATENT DOCUMENTS 4,185,180 A 1/1980 Anderson (Continued)

FOREIGN PATENT DOCUMENTS

JP 50-10807 A 4/1975

(Continued)

OTHER PUBLICATIONS

"Encyclopedia of Electronic Treatment" under the editorship of Yasusaburo Sugi, D.M., professor emeritus of University of Tsukuba, published by Kenyukan in 1993.

(Continued)

*Primary Examiner*—Michael A Friedhofer
(74) *Attorney, Agent, or Firm*—Westerman, Hattori, Daniels & Adrian, LLP.

(57) ABSTRACT

A contact-breaker device that can be miniaturized, realize low power consumption and low cost, and generate an irregular pulse current by causing irregular electrical conduction and insulation of a circuit. The contact-breaker device comprises: fixed terminals 12A and 12B secured at positions spaced apart from each other; and a movable member 11 capable of moving relative to the fixed terminals 12A and 12B and coming into or avoiding contact with the fixed terminals 12A and 12B based on its movement, thereby causing electrical conduction or insulation between the fixed terminals 12A and 12B; wherein the movable member 11 irregularly moves in accordance with externally applied vibration, thereby causing irregular electrical conduction or insulation between the fixed terminals 12A and 12B.

7 Claims, 11 Drawing Sheets

U.S. PATENT DOCUMENTS

| | | | | |
|---|---|---|---|---|
| 4,665,921 | A | | 5/1987 | Teranishi et al. |
| 4,709,438 | A | * | 12/1987 | de Tavares ..... 15/167.1 |
| 4,796,323 | A | * | 1/1989 | Benz ..... 15/23 |
| 4,859,869 | A | * | 8/1989 | Heuwinkel et al. ..... 307/117 |
| 5,599,088 | A | * | 2/1997 | Chien ..... 362/103 |
| 6,334,692 | B1 | * | 1/2002 | Hsueh ..... 362/116 |
| 6,341,400 | B1 | * | 1/2002 | Kobayashi et al. ..... 15/105 |
| 6,397,424 | B1 | * | 6/2002 | Leung ..... 15/105 |
| 6,949,713 | B2 | * | 9/2005 | Weng et al. ..... 200/61.45 R |
| 7,044,618 | B1 | * | 5/2006 | Rapisarda ..... 362/205 |
| 7,170,019 | B2 | * | 1/2007 | Wong et al. ..... 200/61.45 M |
| 7,182,493 | B2 | * | 2/2007 | Huang ..... 362/500 |
| 7,329,019 | B2 | * | 2/2008 | Cheung ..... 362/103 |

FOREIGN PATENT DOCUMENTS

| | | | |
|---|---|---|---|
| JP | 55-116525 | U | 8/1980 |
| JP | 57034846 | | 2/1982 |
| JP | 59-10466 | A | 1/1984 |
| JP | 60-253461 | | 12/1985 |
| JP | 60-253461 | A | 12/1985 |
| JP | 2-49734 | | 2/1990 |
| JP | 2-49734 | | 10/1990 |
| JP | 6-290690 | | 10/1994 |
| JP | 7-167225 | A | 7/1995 |
| JP | 8-162798 | A | 6/1996 |
| JP | 9-108453 | | 4/1997 |
| JP | 11-73831 | | 3/1999 |
| JP | 2000-331579 | A | 11/2000 |
| JP | 2002-163715 | A | 6/2002 |
| JP | 2004-146302 | A | 5/2004 |
| WO | WO 99-62372 | | 9/1999 |

OTHER PUBLICATIONS

"Electronics and Medicine" vol. 454, Jul. 2004, Asamasa Moriyama, D.M., professor of Acupuncture, Department of Tsukuba, College of Technology.

English translation of Office Action issued in Japanese Appln. No. 2005-086770, dated Oct. 30, 2008.

* cited by examiner (1)

(2)

CONTACT-BREAKER DEVICE, CIRCUIT AND APPARATUS COMPRISING THE SAME, AND METHOD FOR ASSEMBLING CONTACT-BREAKER DEVICE

BACKGROUND

The present invention relates to: a contact-breaker device capable of opening or closing a circuit in response to externally applied vibration; a circuit including this contact-breaker device; a high-potential irregular pulse-current generating circuit; a pulse-current generator including the circuit and capable of generating an irregular pulse current; a high-potential irregular pulse-current generator; and a method for assembling the contact-breaker device.

Conventionally, a spring switch and a mercury-contact switch have been used to detect any position change such as micro-vibration or inclination. As a small-sized switch that solves problems of the spring switch and the mercury-contact switch, such as deterioration of elasticity, delicate adjustment methods, low position change sensitivity, and large sizes, Japanese Patent Laid-Open (Kokai) Publication No. HEI 6-290690 discloses a spherical contact switch characterized in that a spherical contact having a conductive surface is placed between two opposed electrode plates with a plurality of electrodes, and a frame for retaining the electrode plates is set around the spherical contact.

Japanese Patent Laid-Open (Kokai) Publication No. HEI 11-73831 discloses a switch device designed to control turning on or off of light, depending on the attitude of an apparatus including the switch device, by means of an attitude detecting function by utilizing a spherical conductive member. This switch device comprises: a unit case; a pair of electrodes that are set up opposite each other with a certain distance between them within the unit case; and a spherical conductive member placed within the unit case in such a way that the spherical conductive member can move within the unit case. Each electrode has an arc electrode face with radius approximately equal to that of the spherical conductive member.

Moreover, Japanese Patent Laid-Open (Kokai) Publication No. HEI 9-108453 discloses a switch that comprises: at least one spherical member, the surface of which is conductive; and a case for accommodating the spherical member in such a way that the spherical member can freely move in the lengthwise direction of the case. At least part of the bottom of the case, and at least part of wall faces near one end of the case in its lengthwise direction, or part of inside wall faces near the end of the case in its lengthwise direction, are respectively formed as terminals. When the respective terminals are energized via the spherical member, this switch allows a doll toy, such as a stuffed toy, to change its movements without a player's direct operation of the switch, simply by holding or laying down the doll toy.

Also, Japanese Patent (Kokoku) Publication No. HEI 2-49734 B2 discloses an electric mouth-cleaning nozzle that comprises a nozzle for spraying a liquid; a handle for supporting the nozzle and for a user to hold with his/her hand; and a high-potential generating circuit including a blocking oscillation circuit; wherein the negative electrode of an output terminal of the high-potential generating circuit is connected to the nozzle, while its positive electrode is connected to the handle.

Furthermore, Japanese Patent Laid-Open (Kokai) Publication No. SHO 60-253461 discloses a high-potential toothbrush that contains a high-potential generating circuit in its handle for a user to hold, wherein the positive electrode of the high-potential generating circuit is exposed on the surface of the handle, and the negative electrode of the high-potential generating circuit is exposed to a brush part.

It has been known that when a low-frequency current is applied to the surface of skin, this stimulation causes normal nervous system excitement; and if there is any abnormal operation of the nervous system, such stimulation would restore the original proper operation of the nervous system. In foreign countries, this is called TENS (Transcutaneous Electrical Nerve Stimulation) and is a common low-frequency treatment. Major physiological actions of the low-frequency treatment are said to be: (1) an effect on motor nerves and muscles, a massage effect, and a kinetic effect; (2) an effect on autonomic nerves and an effect on various chronic diseases; and (3) an effect on sensory nerves and an analgesic effect.

It is a characteristic action of the low-frequency treatment that when an electric current is applied, the negative electrode has an analgesic action and the positive electrode has an excitatory action. However, recent studies conducted by doctors in countries all over the world have found that changes in waveforms or frequencies of a low-frequency current have much more influence on human bodies than the polarity, whether the negative electrode or the positive electrode is used. Specifically speaking, it has been revealed that changes in the waveforms or frequencies of an electric current promote the secretion of a natural analgesic substance called "endorphin" from the brainstem, and have a good influence on the operation of a gate in the spinal cord for controlling pain. As a result, new low-frequency treatment apparatuses have appeared, that automatically output safe and effective waveforms or frequencies, using computers (or microcomputers). (For example, see the "Encyclopedia of Electronic Treatment" under the editorship of Yasusaburo Sugi, D. M., professor emeritus of University of Tsukuba, published by Kenyukan in 1993.)

It is also known that a living body experiences the phenomenon of habituation to a physical stimulation; and even if the living body is stimulated, if it receives the same stimulation, it will become less reactive to the stimulation. (For example, see "Electronics and Medicine" Vol. 454, July 2004, Asamasa Moriyama, D. M., professor of Acupuncture Department of Tsukuba College of Technology.)

However, the switches described in the Japanese Patent Laid-Open (Kokai) Publications Nos. HEI 6-290690, HEI 11-73831, and HEI 9-108453 are configured so that the switches are turned on or off by making the spherical conductive member (or spherical contact) move and come into contact with the pair of electrodes. Accordingly, it is necessary to secure the area for the spherical member to move. Therefore, the switches can hardly be miniaturized, and their electric power consumption is considerable, and their components expensive.

Moreover, the high-potential generating circuit and the high-potential toothbrush described in the Japanese Patent (Kokoku) Publication Nos. HEI 2-49734 B2 and SHO 60-253461 are designed to generate a regular pulse current and, therefore, give constant stimulation (the same stimulation) to a living body (human body). Accordingly, as described in the above-mentioned two patent reference materials, the phenomenon of habituation to physical stimulation occurs and the living body becomes less reactive to the stimulation. Therefore, it is difficult to maintain the relevant advantageous effects for a long period of time.

When the switches described in the Japanese Patent Laid-Open (Kokai) Publications Nos. HEI 6-290690, HEI 11-73831, and HEI 9-108453 are applied to generate an irregular pulse current, which is effective for the invigoration of a human body, by changing the waveforms or frequencies of a low-frequency current as stated in the "Encyclopedia of Electronic Treatment" (supervising editor: Yasusaburo Sugi, D. M., professor emeritus of University of Tsukuba; published by Kenyukan in 1993), they have a problem in that they can hardly be miniaturized as mentioned above and, therefore, they cannot be put in a small space such as the handle of a toothbrush. Moreover, the conventional switches (such as pulse digital circuits) require a large amount of power. Therefore, if a battery is used as its power source, the battery would have a short life span and it would be necessary to replace the battery frequently. Furthermore, since the conventional switches are expensive, there is the problem of an increase in the cost of products containing the switches (such as toothbrushes).

SUMMARY

The present invention aims to solve the above-described conventional problems. It is an object of this invention to provide: a contact-breaker device capable of realizing miniaturization, simple structure, reduction in power consumption, low cost, and the generation of an irregular pulse current by irregularly bringing a circuit including the contact-breaker device into electrical conduction or insulation; a circuit including the contact-breaker device; a high-potential irregular pulse-current generating circuit; a circuit board including the circuit; a pulse-current generator including the circuit; a high-potential irregular pulse-current generator; and a method for assembling the contact-breaker device.

In order to achieve the above-described object, this invention provides a contact-breaker device that comprises: a pair of fixed terminals secured on a supporting member at positions spaced apart from each other; and a movable member capable of moving relative to the pair of fixed terminals and coming into or avoiding contact with the pair of fixed terminals based on its movement, thereby causing electrical conduction or insulation between the fixed terminals; wherein the movable member moves irregularly in accordance with externally applied vibration, thereby causing irregular electrical conduction or insulation between the fixed terminals.

The contact-breaker device having the above-described configuration realizes a simple configuration, miniaturization, reduction in power consumption, and low cost. If it is connected to a desired position of a circuit, it is possible to irregularly bring the circuit into electrical conduction or insulation.

Also, with the contact-breaker device having the above-described configuration, the movable member irregularly moves in response to externally applied vibration, thereby irregularly bringing the pair of fixed terminals into electrical conduction or insulation. Accordingly, an irregular pulse-current is generated by the repeated electrical conduction and insulation. Therefore, in addition to the aforementioned advantageous effect, it is possible to easily generate an irregular pulse current that is effective for the invigoration of the human body.

The contact-breaker device of this invention can be configured so that the movable member is movable in all directions. This configuration allows the movable member to be capable of moving irregularly in response to vibration externally applied in any direction, and further ensures that the pair of fixed terminals is irregularly brought into electrical conduction or insulation.

The contact-breaker device may be configured so that one end of the movable member comes into or avoids contact with one of the fixed terminals, while the other end of the movable member comes into or avoid contact with the other fixed terminal.

The contact-breaker device may also be configured that each of the fixed terminals has a through-hole in which the movable member loosely fits, and both ends of the movable member fit in the through-holes of the respective fixed terminals. In this configuration, the movable member, which loosely fits in the through-holes, can irregularly move in response to externally applied vibration, thereby irregularly coming into contact with or moving away from the edges that define the through-holes. Accordingly, when both ends of the movable member come into contact with the edges which define the respective through-holes in the pair of fixed terminals, this brings the fixed terminals into electrical conduction. On the other hand, when at least one end of the movable member moves away from an edge which defines the through-hole, this brings the fixed terminals into insulation.

Moreover, the contact-breaker device may be configured so that the fixed terminal comprises: a first side wall with the through-hole; and a second side wall formed opposite the first side wall. In addition to the contact or non-contact between the edges that define the through-holes and the movable member, the above-described configuration allows the pair of fixed terminals to be brought into electrical conduction or insulation by way of irregular contact or non-contact between the first side wall and the movable member, and between the second side wall and the movable member.

Furthermore, the fixed terminal may have a cutout which is connected to the through-hole, and through which the movable member can be inserted into the through-hole in a snap-fit manner. The existence of this cutout makes it possible to easily assemble the fixed terminals.

The contact-breaker device of this invention may be configured so that the fixed terminals are located at positions spaced apart from each other by interposing a joint member made of an insulator between the fixed terminals, and a housing including the joint member and the pair of fixed members is configured and the movable member is placed in the housing.

This invention also provides a circuit comprising the aforementioned contact-breaker device of this invention.

In the circuit having the above-described configuration, the contact-breaker device, which is the constituent requirement of the circuit, can realize a simple configuration, miniaturization, reduction in power consumption, and low cost. Also, in the contact-breaker device having the above-described configuration, the movable member irregularly moves in response to externally applied vibration, thereby irregularly bringing the pair of fixed terminals into electrical conduction or insulation. Accordingly, an irregular pulse current is generated by the repeated electrical conduction and insulation. Therefore, in addition to the aforementioned advantageous effect, the circuit of this invention can easily generate an irregular pulse current that is effective for the invigoration of the human body.

Moreover, the circuit of this invention can further comprise: a power source; and an indicator that operates based on an electric current supplied from the power source; wherein the contact-breaker device and the indicator are connected in parallel to the power source; and wherein the indicator operates when a current path in the circuit including the contact-breaker device is broken, and the indicator stops operating when the current path including the contact-breaker device is formed.

The circuit is configured in the above described manner so that when the current path in the circuit including the contact-breaker device is broken (that is, when the current flow in the current path including the contact-breaker device is blocked), the indicator operates and indicates this current-blocked state; and when the current path in the circuit including the contact-breaker device is formed (that is, when the current flows through the current path including the contact-breaker device), the indicator stops such indication. Accordingly, it is possible to easily detect from the outside whether the irregular pulse current is being generated by the circuit.

The circuit of this invention can further comprise a contact electrode in the current path including the contact-breaker device, wherein in the current path including the indicator, there can be a control device for controlling the amount of electric current based on an electric potential difference between the contact-breaker device and the contact electrode.

The circuit can be configured so that the contact electrode includes a pair of terminals spaced apart from each other, and closes the circuit when the pair of terminals is made to come into contact with a conductive object.

Moreover, in the circuit of this invention, at least either the indicator or the control device can be a semiconductor device. Examples of the indicator include a light-emitting device or a sound-generating device. Examples of the control device include an amplifying device.

This invention also provides a circuit board comprising the aforementioned circuit of this invention. In the circuit having the above-described configuration, the contact-breaker device, which is the constituent requirement, can realize a simple configuration, miniaturization, reduction in power consumption, and low cost. Also, in the contact-breaker device having the above-described configuration, the movable member irregularly moves in response to externally applied vibration, thereby irregularly bringing the pair of fixed terminals into electrical conduction or insulation. Accordingly, an irregular pulse current is also generated by the repeated electrical conduction and insulation. Therefore, in addition to the aforementioned advantageous effect, the circuit board of this invention can easily generate an irregular pulse current that is effective for the invigoration of the human body. It is also possible to prevent the occurrence of the phenomenon of habituation to physical stimulation and to maintain the relevant advantageous effects for a long period of time.

Moreover, this invention provides a pulse-current generator that comprises: the above-described contact-breaker device of this invention; a power source connected to the contact-breaker device to supply an electric current to the contact-breaker device; and a contact electrode for controlling the supply of the electric current to the contact-breaker device; wherein the contact electrode includes a pair of terminals spaced apart from each other; when the pair of terminals comes into contact with a conductive object, the electric current is supplied to the contact-breaker device; and when at least either one of the pair of terminals moves away from the object, the supply of the electric current to the contact-breaker device is stopped.

In the pulse-current generator having the above-described configuration, the contact-breaker device, which is the constituent requirement, can realize a simple configuration, miniaturization, reduction in power consumption, and low cost. Also, in the contact-breaker device having the above-described configuration, the movable member irregularly moves in response to externally applied vibration, thereby irregularly bringing the pair of fixed terminals into electrical conduction or insulation. Then, when both ends of the contact electrode are made to come into contact with the object, an irregular pulse current is generated by the repeated electrical conduction and insulation. Therefore, in addition to the aforementioned advantageous effect, the pulse-current generator of this invention can easily generate an irregular pulse current that is effective for the invigoration of the human body. It is also possible to prevent the occurrence of the phenomenon of habituation to physical stimulation and to maintain the relevant advantageous effects for a long period of time.

The pulse-current generator of this invention can further comprise an indicator that operates based on an electric current supplied from the power source, and the pulse-current generator can be configured so that the contact-breaker device and the indicator are connected in parallel to the power source, and the indicator operates when a current path including the contact-breaker device is broken, and the indicator stops operating when the current path including the contact-breaker device is formed.

Because of the above-described configuration of the pulse-current generator, when the current flow in the current path in the circuit including the contact-breaker device is blocked, the indicator operates and indicates this current-blocked state. When the current flows through the current path including the contact-breaker device, the indicator stops such indication. Accordingly, it is possible to easily detect from the outside whether the irregular pulse current is being generated by the pulse-current generator.

Moreover, concerning the pulse-current generator of this invention, the current path including the indicator can include a control device for controlling the amount of electric current based on an electric potential difference between the contact-breaker device and the contact electrode.

Furthermore, the pulse-current generator of this invention can further comprise a driving member for vibrating either one of the terminals of the contact electrode. This configuration allows the terminals of the vibrating contact electrode to come into contact with the object and thereby transmit the vibration to the object.

Moreover, the pulse-current generator of this invention can further comprise: a bristle-implanted part with brush bristles implanted therein; a handle for a user to hold, that contains the power source; a conductive plate connected to one electrode of the power source and placed in such a manner that at least part of the conductive plate is exposed on a surface of the handle; and a conductive member connected to the other electrode of the power source and capable of electrically connecting the brush bristles with the other electrode of the power source. In such a case, the pulse-current generator can be configured so that one terminal of the contact electrode is composed of the conductive plate, and the other terminal of the contact electrode is composed of the brush bristles.

When the user uses the pulse-current generator having the above-described configuration to, for example, brush his/her teeth by holding the handle with his/her fingers touching the conductive plate, it is possible to supply the irregular pulse current generated by the pulse-current generator to the user. Accordingly, the irregular pulse current can be applied between the teeth and the pulse-current generator (for example, the ion toothbrush), thereby breaking cross-linking caused by, for example, calcium ions in saliva between the surfaces of the teeth and dental plaque, effectively removing the plaque, and enhancing the brushing effect. It is also possible to enhance the massage effect on the gums. Similarly, when the user holds the handle with his/her fingers touching the conductive plate and makes the brush bristles touch, for example the skin, it is possible to supply the irregular pulse current generated by the pulse-current generator to the user and to invigorate the skin or the body.

Other than the ion toothbrush, examples of the pulse-current generator having the above-described configuration include the following various apparatuses: a massager, a hair growth apparatus, a facial esthetic apparatus, a body brush, a skin rejuvenating apparatus, a foot sole energizing apparatus, an eyesight recovery apparatus, a shoulder stiffness alleviating apparatus, and a spot remover brush.

The pulse-current generator of this invention can be configured so that the brush bristles and the conductive member are located at positions spaced apart from each other, and a liquid pathway is interposed between the brush bristles and the conductive member, thereby bringing the brush bristles and the conductive member into conduction via the liquid pathway.

Moreover, the pulse-current generator of this invention can be configured so that a conductive connecting member connected to the liquid pathway is placed on at least part of the surface of the bristle-implanted part where the brush bristles are implanted. In this configuration, if the user brushes his/her teeth with the brush bristles, the user's saliva forms the liquid pathway, thereby bringing the brush bristles and the conductive member into electrical conduction. If the conductive connecting member is employed, even if the bristle-implanted part is insufficiently wet at the beginning of the use of the pulse-current generator, it is possible to connect, via the conductive connecting member, the brush bristles to the liquid pathway and to bring the brush bristles and the conductive member into electrical conduction sufficiently even faster.

Furthermore, the pulse-current generator of this invention can comprise a main body including a handle for a user to hold and a contact part that comes into contact with the user's body wherein the main body contains the power source; and wherein one terminal of the contact electrode is composed of at least part of a surface of the handle, and the other terminal of the contact electrode is composed of at least part of a surface of the contact part.

When the user uses the pulse current generator having the above-described configuration by holding the handle with his/her fingers touching the conductive plate and making the contact part come into contact with, for example, the user's skin, it is possible to supply the irregular pulse current generated by the pulse-current generator to the user. Therefore, it is possible to apply the irregular pulse current between the user's skin and the pulse-current generator and to invigorate the skin and the body.

Examples of the pulse-current generator having the above-described configuration include the following various apparatuses: a massager, a hair growth apparatus, a face-washing apparatus, a skin rejuvenating apparatus, a foot sole energizing apparatus, an eyesight recovery apparatus, and a shoulder stiffness alleviating apparatus.

The pulse-current generator of this invention can also comprise the aforementioned circuit of this invention.

Moreover, the pulse-current generator of this invention can comprise the aforementioned circuit board of this invention.

This invention also provides a method for assembling the above-described contact-breaker device on the supporting member, comprising the steps of: installing, in a detachable manner, the contact-breaker device on a tape wound on a reel; unwinding the tape from the reel and peeling off the contact-breaker device, which is installed on the tape in a detachable manner, from the tape; and placing the contact-breaker device peeled off from the tape, at a specified position on the supporting member.

Moreover, this invention provides a method for assembling the above-described contact-breaker device on the supporting member, comprising the steps of: installing, in a detachable manner, the fixed terminals on a tape wound on a reel; unwinding the tape from the reel and peeling off the fixed terminals, which are installed on the tape in a detachable manner, from the tape; and placing the fixed terminals peeled off from the tape, at specified positions on the supporting member.

The above-described assembling methods make it possible to easily assemble the contact-breaker device of this invention on the supporting member.

Examples of the supporting member on which the contact-breaker device is assembled include a substrate for forming a circuit board.

This invention also provides a taping reel comprising: a reel; and a tape wound on the reel; wherein the aforementioned contact-breaker device is installed on the tape.

Furthermore, this invention provides a taping reel comprising: a reel; and a tape wound on the reel; wherein the aforementioned fixed terminals are installed on the tape.

The contact-breaker device of this invention can be configured so that the fixed terminal comprises: a third side wall that is set up on the supporting member and has the through-hole; and a fixed part connected to the third side wall and secured on the supporting member.

In the case of the above-described configuration, the movable member may comprise a restraining part for restraining the movement of the movable member by coming into contact with the third side wall. The existence of this restraining part can prevent the movable member from falling out through the through-hole in the third side wall. In addition to the contact or no contact between the edges that define the through-holes and the movable member, the irregular contact or non-contact between the third side wall and the restraining part can cause irregular electrical conduction or insulation.

The restraining part may be located between the pair of fixed terminals when the movable member loosely fits in the through-holes. In other words, the restraining part may be formed in the approximate midsection of the movable member. The restraining part may also be formed at both ends of the movable member.

In the contact-breaker device of this invention, the supporting member may be a substrate for forming a circuit board.

This invention also provides a circuit comprising the aforementioned contact-breaker device. The circuit having this configuration can easily generate the irregular oscillation wave, using the contact-breaker device.

Moreover, this invention provides a high-potential irregular pulse-current generating circuit comprising: the aforementioned contact-breaker device; and a high-potential generating circuit for generating a regular oscillation wave; and wherein the contact-breaker device turns the regular oscillation wave generated by the high-potential generating circuit, into an irregular oscillation wave. The high-potential irregular pulse-current generating circuit having the above-described configuration can easily generate the irregular oscillation wave, using the contact-breaker device. Accordingly, it is possible to prevent the occurrence of the phenomenon of habituation to physical stimulation and to maintain the relevant advantageous effects for a long period of time.

In this high-potential irregular pulse-current generating circuit, the high-potential generating circuit and the contact-breaker device can constitute a blocking oscillation circuit.

Moreover, the high-potential irregular pulse-current generating circuit of this invention can further comprise: a power source; and an indicator that operates based on an electric current supplied from the power source. This high-potential irregular pulse-current generating circuit may be configured so that the contact-breaker device and the indicator are connected in parallel to the power source; and the indicator operates when a current path including the contact-breaker device is broken, and the indicator stops operating when the current path including the contact-breaker device is formed.

Furthermore, this invention provides a high-potential irregular pulse-current generator that comprises: the aforementioned high-potential irregular pulse-current generating circuit; a power source for supplying an electric current to the high-potential irregular pulse-current generating circuit; a contact electrode for controlling the supply of the electric current to the contact-breaker device; wherein the contact electrode includes a pair of terminals spaced from each other; when the pair of terminals comes into contact with a conductive object, the electric current is supplied to the contact-breaker device; and when at least either one of the pair of terminals moves away from the object, the supply of the electric current to the contact-breaker device is stopped.

This high-potential irregular pulse-current generator can further comprise an indicator that operates based on the electric current supplied from the power source. In such a case, the high-potential irregular pulse-current generator can be configured so that the contact-breaker device and the indicator are connected in parallel to the power source; and the indicator operates when a current path including the contact-breaker device is broken, and the indicator stops operating when the current path including the contact-breaker device is formed.

Moreover, the high-potential irregular pulse-current generator of this invention can further comprise: a bristle-implanted part with brush bristles implanted therein; a handle for a user to hold, that contains the power source and the high-potential pulse-current generating circuit; a conductive plate connected to one electrode of the power source and placed in such a manner that at least part of the conductive plate is exposed on a surface of the handle; and a conductive member connected to the other electrode of the power source and capable of electrically connecting the brush bristles with the other electrode of the power source. In such a case, this high-potential irregular pulse-current generator can be configured so that one terminal of the contact electrode is composed of the conductive plate; and the other terminal of the contact electrode is composed of the brush bristles.

When the user uses the high-potential irregular pulse-current generator having the above-described configuration to, for example, brush his/her teeth by holding the handle with his/her fingers touching the conductive plate, it is possible to supply the irregular pulse current generated by the high-potential irregular pulse-current generator to the user. Accordingly, the irregular pulse current can be applied between the teeth and the high-potential irregular pulse-current generator (for example, the ion toothbrush), thereby breaking cross-linking caused by, for example, calcium ions in saliva between the surfaces of the teeth and dental plaque, effectively removing the plaque, and enhancing the brushing effect. It is also possible to enhance the massage effect on the gums. Similarly, when the user holds the handle with his/her fingers touching the conductive plate and makes the brush bristles touch, for example the skin, it is possible to supply the irregular pulse current generated by the high-potential irregular pulse-current generator to the user and to invigorate the skin or the body.

The contact-breaker device of this invention can realize a simple configuration, miniaturization, reduction in power consumption, and low cost. If it is connected to a desired position of a circuit, it is possible to irregularly bring the circuit into electrical conduction or insulation. Accordingly, it is possible to easily generate an irregular pulse current that is effective for the invigoration of the human body, in response to externally applied vibration.

The circuit and the circuit board of this invention can realize a simple configuration, miniaturization, reduction in power consumption, and low cost, and can easily generate an irregular pulse current that is effective for the invigoration of the human body, in response to externally applied vibration.

Moreover, the pulse-current generator of this invention can realize a simple configuration, miniaturization, reduction in power consumption, and low cost, and can easily generate an irregular pulse current that is effective for the invigoration of the human body, in response to externally applied vibration. It is also possible to prevent the occurrence of the phenomenon of habituation to physical stimulation and to maintain the relevant advantageous effects for a long period of time.

With the method for assembling the contact-breaker device according to this invention it is possible to easily assemble the contact-breaker device on the supporting member.

Moreover, in the high-potential irregular pulse-current generating circuit of this invention, the contact-breaker device can change the regular oscillation wave to an irregular oscillation wave in response to externally or internally applied vibration. Therefore, it is possible to prevent the occurrence of the phenomenon of habituation to physical stimulation and to maintain the relevant advantageous effects for a long period of time.

DESCRIPTION OF DRAWINGS

FIG. 10(2) is a fragmentary enlarged sectional view of FIG. 10(1).

DETAILED DESCRIPTION

The contact-breaker device of this invention, the circuit comprising this contact-breaker device, the circuit board including this circuit, and the pulse-current generator are described below with reference to the attached drawings. The embodiments described below are for the purpose of the illustration of this invention only, and the invention is not limited only to these embodiments. Accordingly, this invention can be utilized in various ways unless the utilizations depart from the gist of the invention.

EMBODIMENT 1

Figure 1:
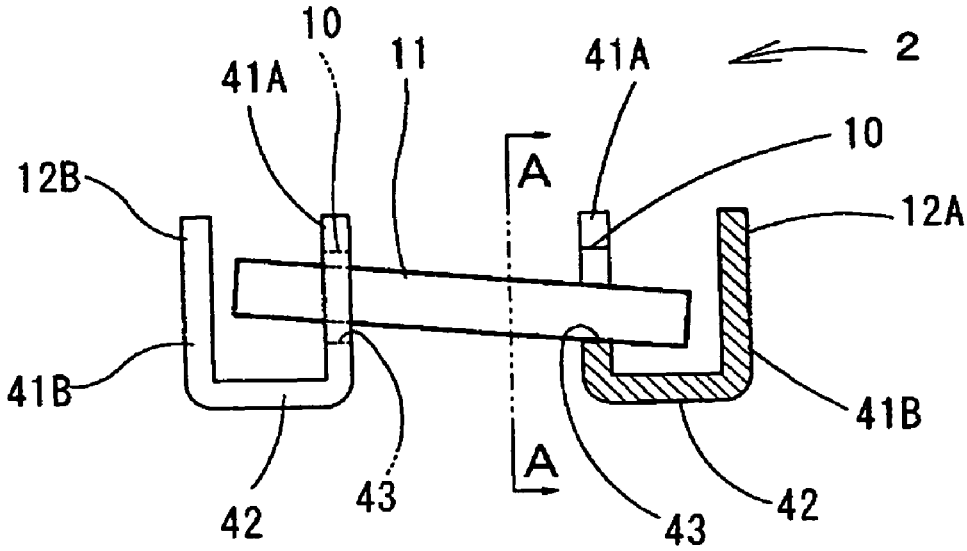
FIG. 1 is a partly sectional side view of a contact-breaker device according to Embodiment 1 of the present invention as taken along line B-B in FIG. 2.
Figure 2:
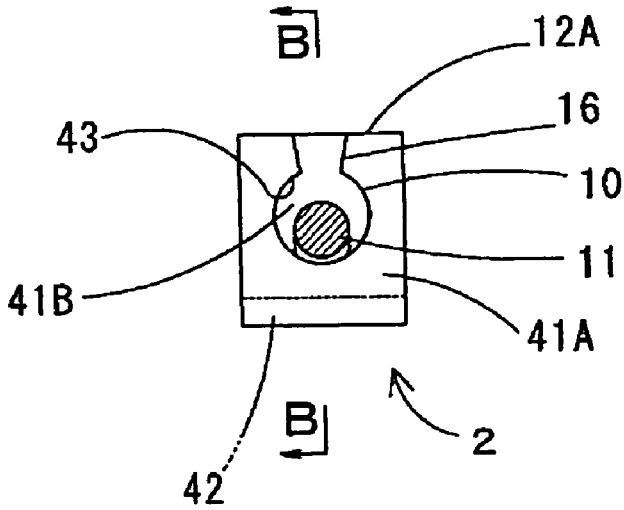
FIG. 2 is a sectional view of the contact-breaker device as taken along line A-A in FIG. 1.
Figure 3:
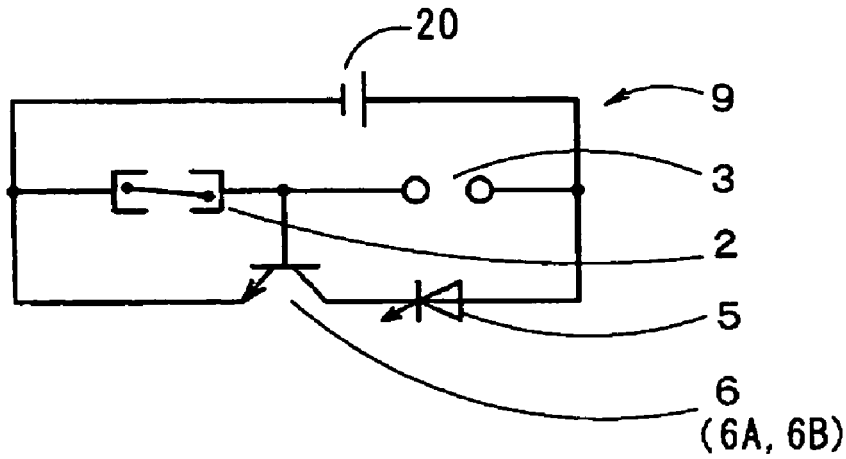
FIG. 3 is a diagram illustrating a circuit including the contact-breaker device according to Embodiment 1 of this invention.
Figure 4:
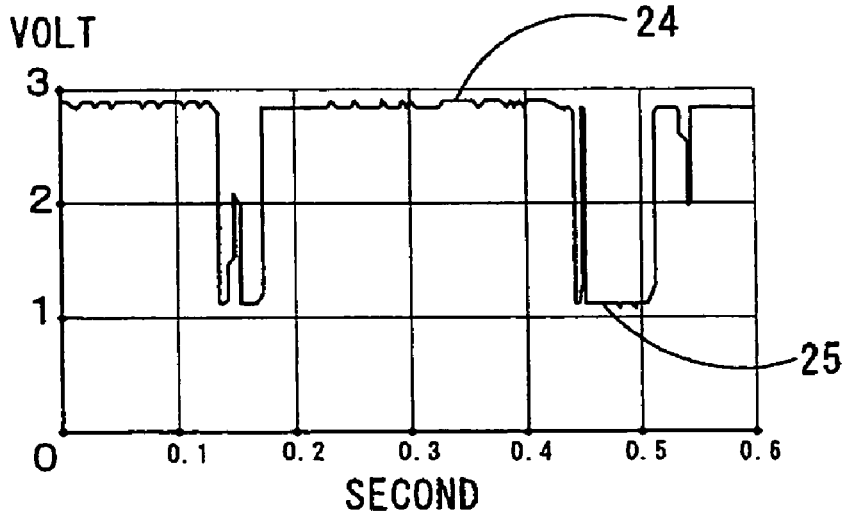
FIG. 4 shows an example of an irregular pulse current generated by the circuit shown in FIG. 3.
Figure 5:
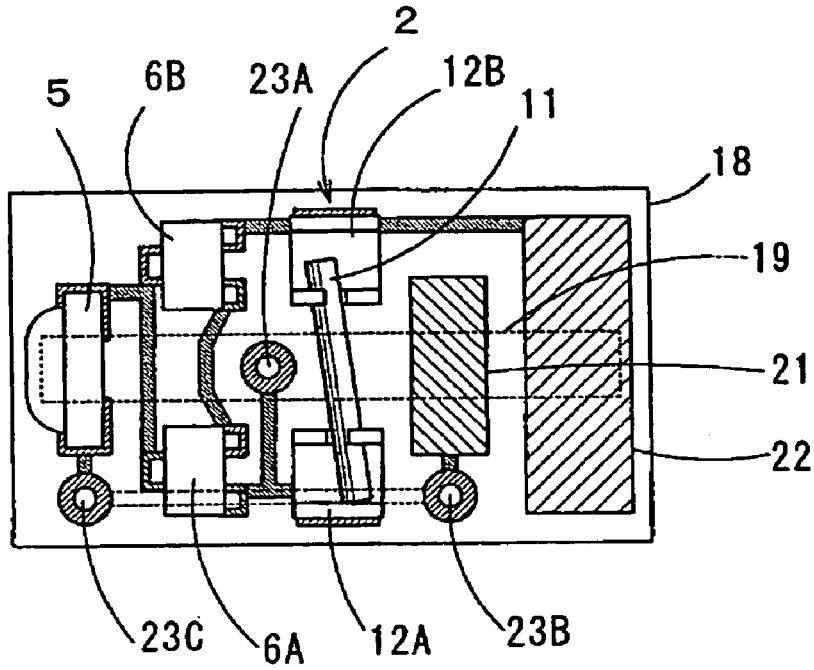
FIG. 5 is a schematic diagram of a circuit board, including part of the circuit shown in FIG. 3.
Figure 6:
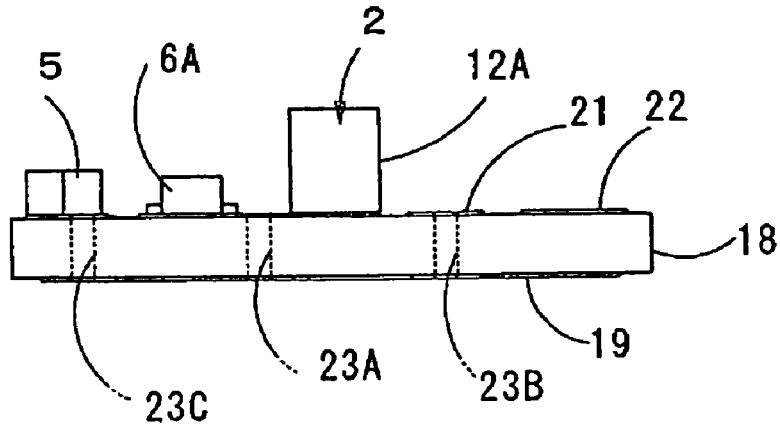
FIG. 6 is a side view of the circuit board shown in FIG. 5.
Figure 7:
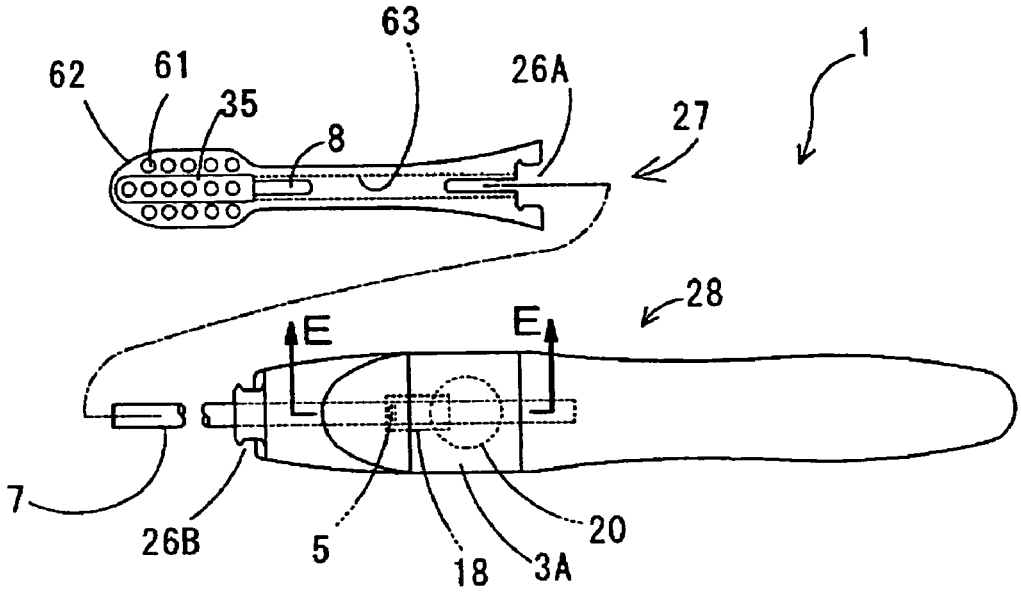
FIG. 7 is an exploded plan view of an ion toothbrush as a pulse-current generator in which the circuit board shown in FIGS. 5 and 6 is placed.
Figure 8:
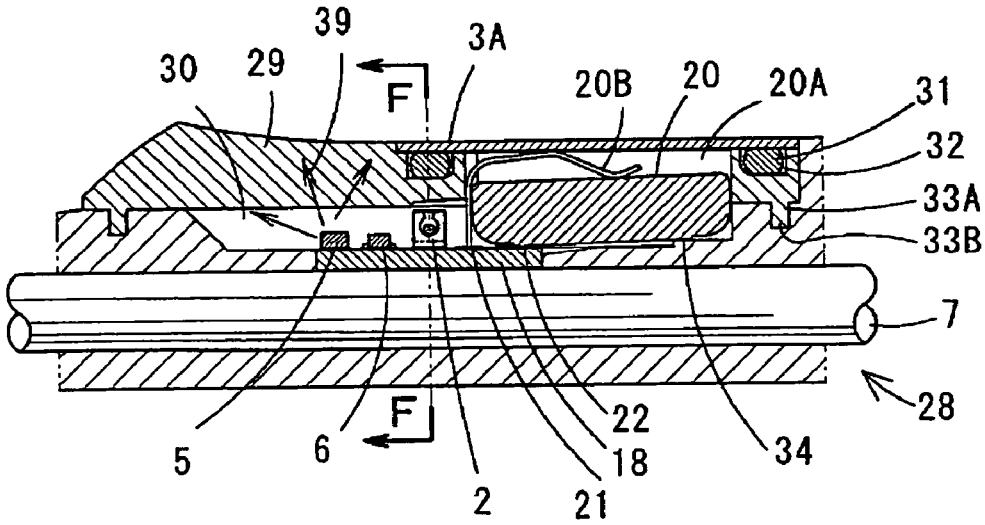
FIG. 8 is a sectional view of the ion toothbrush as taken along line E-E in FIG. 7.
Figure 9:
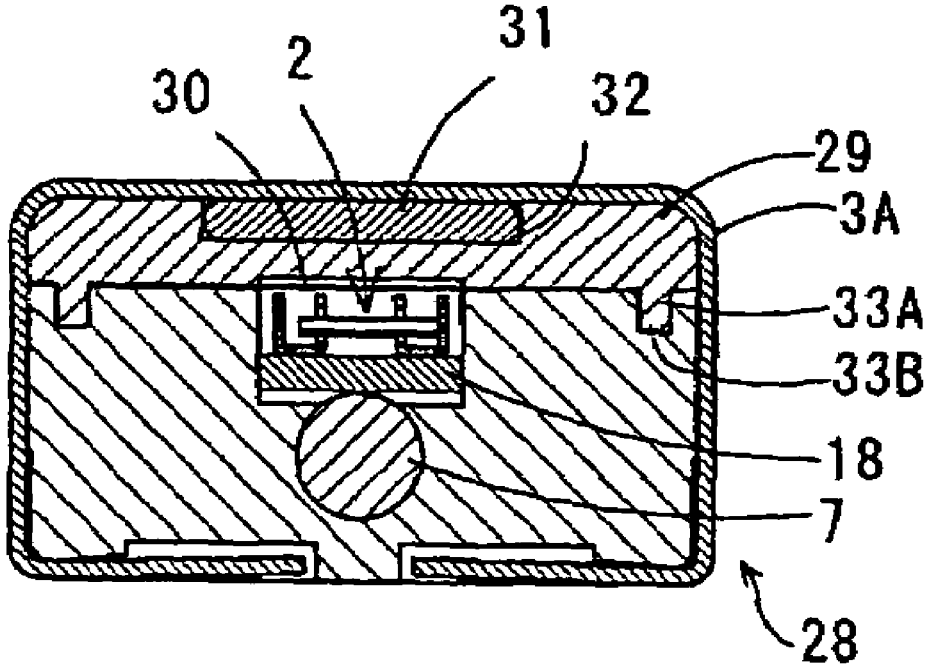
FIG. 9 is a sectional view of the ion toothbrush as taken along line F-F in FIG. 8.

FIG. 1 is a partly sectional side view of a contact-breaker device according to Embodiment 1 of the present invention as taken along line B-B in FIG. 2. FIG. 2 is a sectional view of the contact-breaker device as taken along line A-A in FIG. 1. FIG. 3 is a diagram illustrative of a circuit with the contact-breaker device according to Embodiment 1 of this invention. FIG. 4 shows an example of an irregular pulse current generated by the circuit shown in FIG. 3. FIG. 5 is a schematic diagram of a circuit board including part of the circuit shown in FIG. 3. FIG. 6 is a side view of the circuit board shown in FIG. 5. FIG. 7 is an exploded plan view of an ion toothbrush as a pulse-current generator in which the circuit board shown in FIGS. 5 and 6 is placed. FIG. 8 is a sectional view of the ion toothbrush as taken along line E-E in FIG. 7. FIG. 9 is a sectional view of the ion toothbrush as taken along line F-F in FIG. 8.

As shown in FIGS. 1 and 2, a contact-breaker device 2 according to Embodiment 1 comprises: a pair of fixed terminals 12A and 12B secured on a substrate 18, which is a supporting member, at positions spaced apart from each other (see FIGS. 5 and 6); and a movable member 11 capable of moving relative to the pair of fixed terminals 12A and 12B and coming into or avoiding contact with the fixed terminals 12A and 12B based on its movement, thereby causing electrical conduction or insulation between the fixed terminals 12A and 12B.

Both the fixed terminals 12A and 12B are made of conductive materials (a plate of brass or phosphor bronze coated with 18-carat gold, or a plate-shaped material made of 18-carat gold). Each fixed terminal 12A or 12B includes a pair of side walls 41A and 41 B and a bottom 42 that connects one end of the side wall 41 A with one end of the side wall 41 B, and thereby has a U-shaped cross section (see FIG. 1). These fixed terminals 12A and 12B are placed so as to locate the side walls 41 opposite each other. In the approximate midsection of each side wall 41A, a through-hole 10 of a diameter larger than that of the movable member 11 is formed. The movable member 11 loosely fits in the through-holes 10. The side wall 41 also has a cutout 16 that is connected to the through-hole 10 and is open from the through-hole 10 toward the surface opposite the bottom 42. This cutout 16 is tapered toward the through-hole 10 (see FIG. 2), and the movable member 11 can be inserted through the cutout 16 into the through-hole 10 in a snap-fit manner.

The movable member 11 is made of conductive materials (a plate of brass or phosphor bronze coated with 18-carat gold, or a bar-shaped material made of 18-carat gold), and is substantially cylindrical. The length of the movable member 11 is shorter than the distance between the side wall 41B of the fixed terminal 12A and the side wall 41B of the fixed terminal 12B but longer than the distance between the side wall 41 A of the fixed terminal 12A and the side wall 41 A of the fixed terminal 12A. One end of the movable member 11 loosely fits in the through-hole 10 of the fixed terminal 12A, while the other end of the movable member 11 loosely fits in the through-hole 10 of the fixed terminal 12B.

In the contact-breaker device 2 having the above-described configuration, the movable member 11 loosely fits in the through-holes 10. Accordingly, the movable member 11 irregularly moves in response to externally applied vibration, coming into or avoiding contact with an edge 43 that defines the through-hole 10, and/or the side wall 41B. The movable member 11 can move in all directions. Therefore, it can make the above-described movement in response to vibration applied in any direction.

Even if the external vibration is applied regularly, the movable member 11 moves irregularly and thereby generates an irregular pulse current. In order to verify this phenomenon, the applicant of this invention conducted the following experiment:

A vibration test device secured on the floor was used to monitor the movement of the contact-breaker device 2 by applying vibration to the contact-breaker device 2 in a reciprocating stroke of 12 mm at a rate of 2.8 cycles/sec, 3 cycles/sec, 3.5 cycles/sec, 4 cycles/sec, 4.2 cycles/sec, 4.3 cycles/sec, 50 cycles/sec, and 517 cycles/sec, for a total of 28 hours (cumulative number of cycles: 436120 cycles). As a result, the movable member 11 moved irregularly and generated an irregular pulse current. In this experiment, a bar-shaped material that was of 0.4 mm diameter, 3.3 mm long, made of 18-carat gold, and weighed 0.0058 g was used as the movable member 11.

This experiment can lead to the following analysis. When viewing the contact-breaker device 2 on a microscopic level, irregular protrusions and indentations can be seen on the surfaces of the movable member 11 and the fixed terminals 12A and 12B (in other words, their surfaces are rough). As the movable member 11 moves (or flies) in all directions within the space defined by the fixed terminals 12A and 12B, the irregular protrusions and indentations on the surface of the movable member 11 collide with the irregular protrusions and indentations on the surfaces of the fixed terminals 12A and 12B, thereby causing the movable member 11 to repeat the moving (or flying) action. Consequently, a turbulent airflow is generated in the defined space. The phenomenon of the collision between the irregular protrusions and indentations and the generation of the turbulent airflow causes the movement path (or flight path) of the movable member 11 to change constantly, even if regular vibration is externally applied to the contact-breaker device 2. As a result, the contact-breaker device 2 generates an irregular pulse current.

Because of the above-described configuration, when both ends of the movable member 11 come into contact with the edges 43, which respectively define the through-holes 10, and/or the side walls 41B of the pair of fixed terminals 12A and 12B, this brings the fixed terminals 12A and 12B into electric conduction. On the other hand, when at least one end of the movable member 11 moves away from the edge 43, which defines the through-hole 10, and/or the side wall 41B, this brings the fixed terminals 12A and 12B into insulation. Therefore, the movable member 11 irregularly moving in response to the externally applied vibration thereby irregularly brings the pair of fixed terminals 12A and 12B into electric conduction or insulation. In other words, the edges 43, which define the through-holes 10, and the side walls 41B are the contact points (or electrodes) of the fixed terminals 12A and 12B.

As shown in FIG. 3, a circuit 9 including the contact-breaker device 2 comprises: a power source 20 (such as a 3-V battery); a light-emitting device (LED) 5 as an indicator that operates based on an electric current supplied from the power source 20 and is connected with the contact-breaker device 2 in parallel to the power source 20; a contact electrode 3 placed in a current path including the contact-breaker device 2; and an amplifying device 6 that is placed in a current path including the light-emitting device 5 and serves as a control device for controlling the amount of current based on the electric potential difference between the contact-breaker device 2 and the contact electrode 3 (there may be two amplifying devices 6A and 6B, as shown in FIG. 5, in order to enhance an amplification factor for making the light-emitting device 5 emit light).

The contact electrode includes a pair of terminals spaced apart from each other and becomes conductive when the pair of terminals is made to come into contact with a conductive object (such as a human body).

The light-emitting device 5 operates and emits light when the current path including the contact-breaker device 2 is broken; and the light-emitting device 5 stops operating and no longer emits light when the current path including the contact-breaker device 2 is formed.

With the circuit 9 having the above-described configuration, the movable member 11 of the contact-breaker device 2 moves irregularly when both terminals of the contact electrode 3 are made to have contact with the conductive object to maintain the electrically conductive state, and when vibration is applied externally to the circuit 9. When both ends of the movable member 11 irregularly come into contact with the edges 43, which define the through-holes 10, and the side walls 41B of the pair of fixed terminals 12A and 12B, the current path including the contact electrode 3, the contact-breaker device 2, the power source 20, and the conductive object is formed, thereby supplying an electric current of comparatively large voltage via the contact electrode 3 to the conductive object. When this happens, no electric current flows into the current path including the power source 20, the light-emitting device 5, and the amplifying device 6 (or 6A and 6B) and, therefore, the light-emitting device 5 emits no light.

On the other hand, when the irregular movement of the movable member 11 of the contact-breaker device 2 causes at least one end of the movable member 11 to move away from the edge 43, which defines the through-hole 10, and/or the side wall 41B, the current path including the contact electrode 3, the contact-breaker device 2, the power source 20, and the conductive object is formed, thereby supplying an electric current to the current path including the power source 20, the light-emitting device 5, and the amplifying device 6 (or 6A and 6B) and, therefore, the supplied current makes the light-emitting device 5 emit light.

Since the movement of the movable member 11 of the contact-breaker device 2 is repeated irregularly as stated above, the contact electrode 3 generates an irregular pulse current as shown in FIG. 4. Referring to FIG. 4, reference numeral 24 indicates a top voltage, and reference numeral 25 indicates a bottom voltage.

If, for example, the voltage of the power source is 3 V and the internal resistance of the contact-breaker device 2 is 0.1 V, and when the current path including the contact electrode 3, the contact-breaker device 2, the power source 20, and the conductive object is formed, an electric current of 2.9 V (3 V−0.1 V) is supplied to the conductive object (see the top voltage indicated with the reference numeral 24). On the other hand, when the current path including the contact electrode 3, the contact-breaker device 2, the power source 20, and the conductive object is broken, the light-emitting device 5 emits light (or lights up). If the voltage necessary for the light-emitting device 5 and the amplifying device 6 (or 6A and 6B) is 1.8 V, an electric current of 1.2 V is supplied to the conductive object (see the bottom voltage indicated with the reference numeral 25). As a result, a pulse current with a top voltage of 2.9 V and a bottom voltage of 1.2 V is generated in irregular cycles, and the pulse current of 2.9 V and 1.2 V voltages is supplied to the conductive object in irregular cycles.

In Embodiment 1, if the vibration given to the circuit 9 was reciprocating motion in 1 to 4 cycles per seconds, time required to reach the bottom voltage would be instantaneously short, that is, approximately 4/1000 seconds to 5/100 seconds, and time required to reach the top voltage would be approximately 0.04 seconds to 0.25 seconds.

The circuit 9 is formed on an appropriate substrate, thereby constituting a circuit board. In Embodiment 1, the power source 20 and the contact electrode 3 are not directly formed on a substrate 18, as shown in FIGS. 5 and 6, because the circuit 9 is incorporated into an ion toothbrush 1 as a pulse-current generator, as shown in FIGS. 7 to 9. Specifically speaking, the contact-breaker device 2, the light-emitting device 5, and the amplifying device 6 (or 6A and 6B) among the components of the circuit 9 are formed on the substrate 18. Reference numeral 21 indicates a positive-electrode connecting terminal to be connected to a positive terminal of the power source 20 placed outside the substrate 18. Reference numeral 22 indicates a negative-electrode connecting terminal to be connected to a negative terminal of the power source 20. Reference numeral 23A indicates a through-hole for bringing a connecting terminal 19 (which is a conductive member 7 that is a component of the ion toothbrush described later in detail and shown in FIGS. 7 to 9) placed on the back side of the substrate 18, and the fixed terminal 12A and the amplifying device 6A on the surface of the substrate 18, into electric conduction. Reference numerals 23B and 23C indicate through-holes for bringing the positive-electrode connecting terminal 21 and the light-emitting device 5 on the surface of the substrate 18, into electric conduction.

As shown in FIGS. 7 to 9, the ion toothbrush 1 comprises: a handle 28 for a user to hold with his/her hand; and a head 27 that can be attached to or detached from the handle 28 and has brush bristles 61 implanted therein.

On the top end area of the head 27, there is a bristle-implanted part 62 where the brush bristles are implanted. A conductive connecting member 35 is placed on the surface of the bristle-implanted part 62 from which the brush bristles 61 extend. On the base end area of the head 27, there is an attachable concave part 26A that can engage with or be detached from an attachable convex part 26B formed on the handle 28 described later in detail. Inside the head 27, a conductive member insertion hole 63 is formed, that is connected to the attachable concave part 26A and extends toward an area near the base end of the bristle-implanted area 62. The conductive member 7 described later in detail is inserted into this conductive member insertion hole 63 in a detachable manner.

At the top end of the conductive member insertion hole 63 close to the bristle-implanted part 22, there is a liquid pathway 8 designed to receive liquids such as saliva and water when a user brushes his/her teeth with the ion toothbrush 1. This liquid pathway 8 is connected to the conductive connecting member 35, and the liquid is used as a medium to enable electric conduction between the brush bristles 61 and the conductive member 7. The brush bristles 61 serve as one terminal of the aforementioned contact electrode 3.

The handle 28 has a cross section substantially rectangular in shape. At one end of the handle 28 that is attached to or detached from the head 27 (this end is hereinafter referred to as the "top end"), the attachable convex part 26 that can engage with or be detached from the attachable concave part 26A of the head 27 is formed. In the approximate midsection of the handle 28 along its lengthwise direction, there are a battery-receiving hole 20A for receiving the power source 20 (such as a 3-V battery) and a horizontal hole 30 that is connected to the battery-receiving hole 20A, extends toward the top end of the handle 28 along its lengthwise direction, and accommodates the substrate 18 on which the aforementioned circuit is formed. At the approximate center-bottom of this horizontal hole 30, a part of the conductive member 7 located in the approximate midsection of the handle 28 along its lengthwise direction is exposed as described later in detail. The part of the conductive member 7 exposed to the horizontal hole 30 is in contact with the connecting terminal 19 formed on the back side of the substrate 18. Therefore, the conductive member 7 is connected via the connecting terminal 19 on the back side of the substrate 18, and then via the through-hole 23A, to the fixed terminal 12A and the amplifying device 6A on the surface of the substrate 18. The positive electrode of the power source 20 is connected via a connecting spring 20B to the positive-electrode connecting terminal 21 of the substrate 18. The negative electrode of the power source 20 and the negative-electrode connecting terminal 22 of the substrate 18 are placed in partial contact with each other and, therefore, the negative-electrode connecting terminal 22 is connected to the negative electrode of the power source 20.

In the battery-receiving hole 20A, an inclined support part 34 is formed to support the power source 20 by tilting it toward the substrate 18. This inclined support part 34 ensures that the power source 20 comes into contact with the negative-electrode connecting terminal 22 formed on the substrate 18.

A transparent cover 29, which has an opening in the area corresponding to the battery-receiving hole 20A, is closely attached to the surface (the top face in FIG. 8) of the handle 28 where the battery-receiving hole 20A and the horizontal hole 30 are open, in such a way that the cover 29 closes the horizontal hole 30. When the light-emitting device 5 formed on the substrate 18 flickers, it is possible to see the flickering light 39 (see FIG. 8) from outside because the cover 29 is transparent. In an area close to the opening of the transparent cover 29, a sealing groove 32 for receiving a sealing member 31 (an O ring in Embodiment 1) is formed. A sealing convex part 33A for maintaining sealability of the handle 28 is formed around the entire periphery of the transparent cover 29 (see reference numeral 33A in FIGS. 8 and 9), and a concave part 33B to which the sealing convex part 33A can be inserted is formed in the part of the handle 28 corresponding to the sealing convex part 33A. The sealing convex part 33A and the concave part 33B are welded together, for example, by ultrasonic welding.

A conductive plate 3A made of a conductive material such as titanium or stainless steel is closely attached to the surface of the transparent cover 29 in such a way that the conductive plate 3A closes the battery-receiving hole 20A. This conductive plate 3A is connected via the connecting spring 20B to the positive electrode of the power source 20. Accordingly, the conductive plate 3A serves as the other terminal of the aforementioned contact electrode 3.

The top end of the conductive member 7 extends within the handle 28 in its lengthwise direction toward its top end and further extends out of the handle 28 from the attachable convex part 26B. When the head 27 is attached to the handle 28, the conductive member 7 fits into the conductive member insertion hole 63 in the head 27.

When a user uses the ion toothbrush 1 having the above-described configuration by holding the handle 28, with his/her fingers touching the conductive plate 3A, and brushing his/her teeth with the brush bristles 61, the brush bristles 61 become wet with liquids such as saliva and water, which then reach the liquid pathway 8, thereby causing, via the liquid pathway 8, the conductive member 7 to enter an electrically conductive state. This causes an electric current to pass through the route starting from the positive electrode of the power source 20, and through the conductive plate 3A, the user's hand, body, and teeth, the brush bristles 61, the liquid pathway 8, the conductive member 7, and the circuit formed on the substrate 18, and back to the negative electrode of the power source 20. The resulting electrical potential gradient can enhance the plaque removal effect when brushing teeth.

The user's teeth-brushing motion provides vibration to the ion toothbrush 1. When the movable member 11 of the contact-breaker device 2 is in contact with the fixed terminals 12A and 12B (hereinafter sometimes referred to as "ON states"), the electric current of the top voltage as shown in FIG. 4 is supplied to the user. When this happens, the light-emitting device 5 emits no light. On the other hand, when the movable member 11 of the contact-breaker device 2 is no longer in contact with the fixed terminal(s) 12A and/or 12B (hereinafter sometimes referred to as "OFF state"), the electric current of the bottom voltage as shown in FIG. 4 is supplied to the user. When this happens, the light-emitting device 5 lights up (or emits light). As the teeth-brushing motion generates vibration, the ON state and the OFF state are irregularly repeated, thereby supplying an irregular pulse current to the user.

Figure 10:
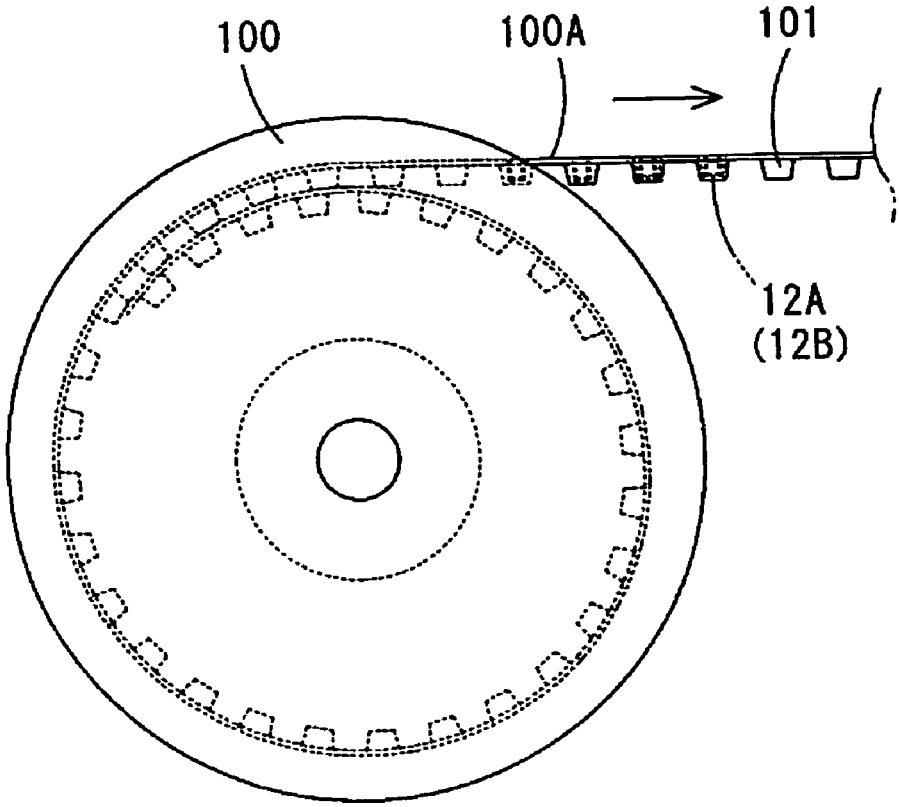
FIG. 10(1) is a schematic diagram that shows part of the step of manufacturing the contact-breaker device according to Embodiment 1 of this invention.
Figure 10:
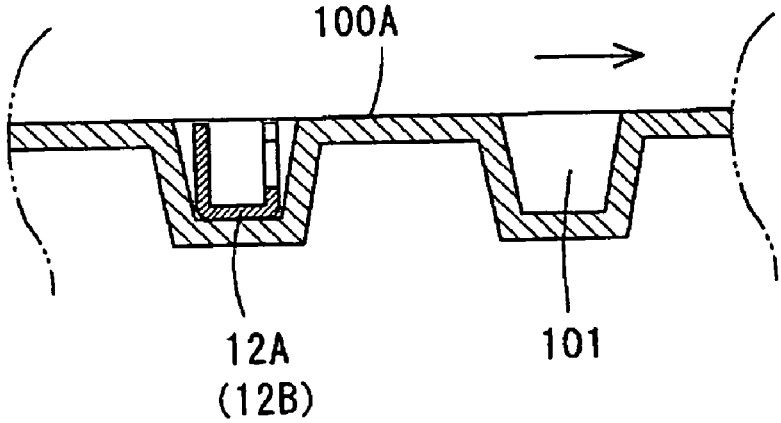

The contact-breaker device 2 according to Embodiment 1 may be placed at a specified position on the substrate 18, for example, by using a taping reel as shown in FIG. 10. Specifically speaking, the taping reel 100 is a reel on which a tape 100A (for example, 0.38 mm thick) is wound. A plurality of depressed parts 101 are formed on the tape 100A. Each depressed part 101 accommodates, for example, the fixed terminal 12A (or 12B). A thin transparent coating film (for example, 0.1 mm) (not shown in the drawings) is applied to the top face of the tape 100A where the depressed parts 101 containing the fixed terminals 12A (or 12B) are located.

In order to place the fixed terminal 12A (or 12B) at a specified position on the substrate 18 by using the taping reel 100, the taping reel 100A is first unwound. Before the step of surface mounting (such as soldering) to the substrate 18, the thin transparent coating film (not shown in the drawings) is peeled off and the fixed terminal 12A (or 12B) contained in the depressed part 101 is then taken out by means of vacuum adsorption using a nozzle at the end of a robot arm. Subsequently, the fixed terminal 12A (or 12B)is moved to and placed at the specified position on the substrate 18.

It is also possible to put the contact-breaker device 2 or other components in the depressed part 101, in order to place them on the substrate 18 in the same manner.

Embodiment 1 has described a case where the light-emitting device 5 is used as the indicator. However, without limitation to this configuration, it is also possible to use, for example, a sound-generating device as long as the indicator has the function of operating based on the electric current supplied from the power source 20 so that the user can be aware of the supply state of the pulse current from outside. In such a case, the cover 29 does not have to be transparent.

Moreover, the ion toothbrush 1 according to Embodiment 1 has described a case where the conductive connecting member 35 is placed over the surface of the bristle-implanted part 62 of the head 27 from which the brush bristles 61 extend. However, without limitation to this configuration, the conductive connecting member 35 may not be used, if so desired.

Furthermore, Embodiment 1 has described the ion toothbrush 1 having a head 27 which can be detached from the handle 28. However, without limitation to this configuration, the head 27 may be formed integrally with the handle 28.

Concerning Embodiment 1, a case where two amplifying devices 6A and 6B are included for the purpose of enhancing the amplification factor to cause the light-emitting device 5 to emit light has been described (see FIG. 5). However, it is possible to decide the number of amplifying devices to be mounted arbitrarily, according to the desired conditions. In general, for example, the amplification factor effected by one amplifying device is approximately 120× to 390×, and the amplification factor effected by two amplifying devices is approximately 14000× to 15000×. The amplification factor effected by a Darlington amplifier, a united form of two amplifying devices, is approximately 4000× to 20000×. Therefore, the amplifying device(s) may be selected according to various conditions, such as cost and the size of the substrate on which it will be placed.

The numerical values of the voltage of the power source 20, and the internal resistance, top voltage, and bottom voltage of the contact-breaker device 2 as used in the description of Embodiment 1 are indicated as examples, and can be decided arbitrarily.

EMBODIMENT 2

A contact-breaker device according to Embodiment 2 of this invention is described below with reference to the relevant drawings. Components used in Embodiment 2 that are similar to those described in Embodiment 1 are given the same reference numerals as those in Embodiment 1, and any detailed description thereof is omitted.

Figure 11:
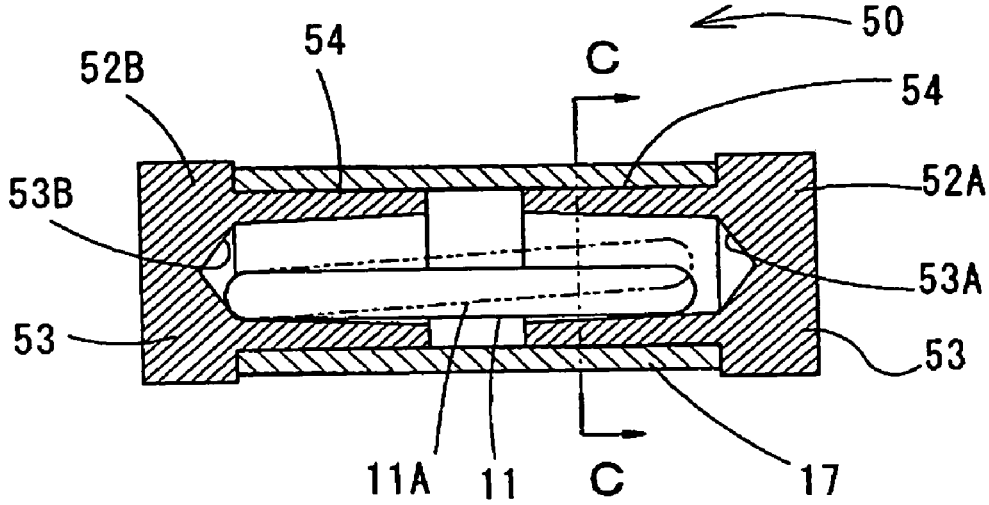
FIG. 11 is a sectional view of a contact-breaker device according to Embodiment 2 of this invention.
Figure 12:
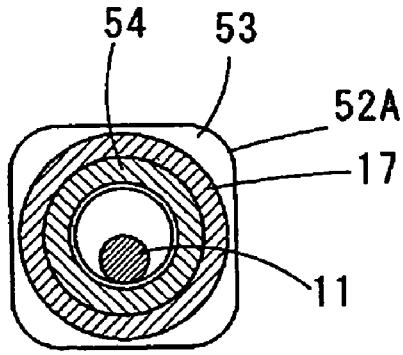
FIG. 12 is a sectional view of the contact-breaker device as taken along line C-C in FIG. 11.

FIG. 11 is a sectional view of the contact-breaker device according to Embodiment 2. FIG. 12 is a sectional view of the contact-breaker device as taken along line C-C in FIG. 11.

As shown in FIGS. 11 and 12, in a contact-breaker device 50 according to Embodiment 2, a joint member 17 of substantially cylindrical shape made of an insulator, and fixed terminals 52A and 52B located at position spaced apart from each other by interposing the joint member 17 between them constitute a housing 51.

The fixed terminals 52A and 52B comprise: closing parts 53 that close both ends of the joint member 17; and a cylindrical part 54 that is connected to the closing parts 53 and extends along the inside surface of the joint member 17 to form a cylindrical shape. The closing parts 53 respectively have tapered faces 53A and 53B on their inside surfaces. In the fixed terminals 52A and 52B, not only the tapered faces 53A and 53B, but also the inside surface of the cylindrical part 54 is tapered, so that they serve as contact points for the movable member 11.

The inside surface of the cylindrical part 54 is tapered so that its inside diameter becomes slightly larger toward its central part, away from the closing parts 53. Because of this taper, the movable member 11 comes into spot-contact with the inside surface of the cylindrical part 54. Therefore, generation of chattering vibration is controlled. Even if the movable member 11 is of very minute size and weighs very little (for example, 0.4 mm in diameter, 3.3 mm long, and 0.0058 g in weight), the pressure per unit area on the contact spot becomes a desired value for the electric current flow, thereby enabling efficient contact or no contact.

In the contact-breaker device 50 having the above-described configuration, the movable member 11 moves freely within the housing composed of the fixed terminals 52A and 52B and the joint member 17. Accordingly, the movable member 11 is designed to irregularly move in response to externally applied vibration, thereby coming into contact with or moving away from the tapered face 53A and its adjacent area of the cylindrical part 54. Incidentally, the movable member 11 can move in all directions. Therefore, it can make the above-described movement if vibration in any direction is applied. However, when no vibration is applied to the contact-breaker device 50, the movable member 11 is in contact with the fixed terminals 52A and 52B as shown with a full line in FIG. 11. On the other hand, when the vibration is applied to the contact-breaker device 50, one end of the movable member 11 moves away from the fixed terminal 52A as shown with a dashed line in FIG. 11, or the other end of the movable member 11 moves away from the fixed terminal 52B, or the entire movable member 11 moves away from both of the fixed terminals 52A and 52B.

Because of the above-described configuration, the fixed terminals 52A and 52B are brought into electric conduction when both ends of the movable member 11 come into contact with the pair of fixed terminals 52A and 52B. When at least one end of the movable member 11 moves away from the fixed terminal 52A or 52B, this brings the fixed terminals 52A and 52B into insulation. Consequently, the movable member 11 moves irregularly in response to externally applied vibration, thereby irregularly bringing the pair of fixed terminals 52A and 52B into electric conduction or insulation.

The contact-breaker device 50 is also incorporated into the circuit and installed on the pulse-current generator in the same manner as in Embodiment 1, and exhibits a function similar to that of Embodiment 1.

EMBODIMENT 3

A pulse-current generator according to Embodiment 3 is described below with reference to the relevant drawings. Components used in Embodiment 3 that are similar to those described in Embodiments 1 and 2 are given the same reference numerals as those in Embodiments 1 and 2, and any detailed description thereof is omitted.

Figure 13:
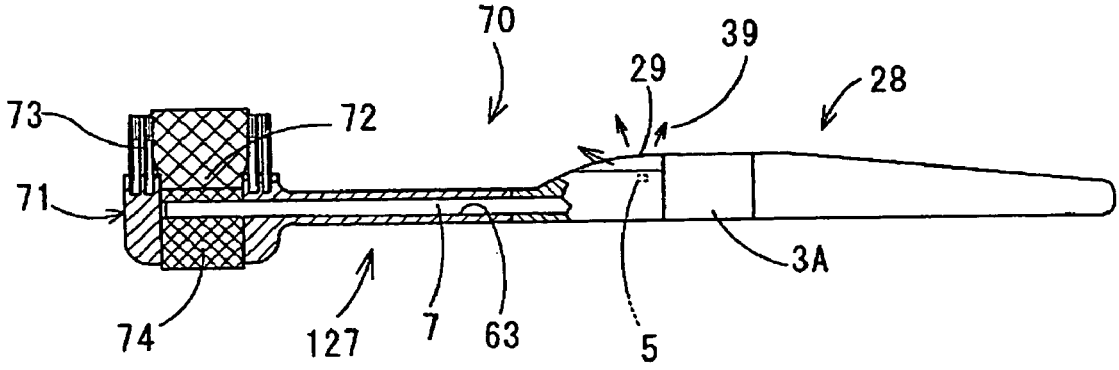
FIG. 13 is a partly sectional side view of a facial esthetic apparatus as a pulse-current generator according to Embodiment 3 of this invention.

FIG. 13 is a partly sectional side view of a facial esthetic apparatus as the pulse-current generator according to Embodiment 3.

As shown in FIG. 13, a major structural difference between a facial esthetic apparatus 70 of Embodiment 3 and the ion toothbrush 1 of Embodiment 1 is the configuration of the head 127. The top end of the head 127 is formed as a bristle-implanted part 71. A sponge 72 is placed in the approximate center area on one side of the bristle-implanted part 71, and bristles 73 are implanted around the sponge 72. In the approximate center area on the other side of the bristle-implanted part 71, there is a sponge 74 that has different properties (such as quality of material, hardness, or porosity) from those of the sponge 72.

Inside the head 127, the conductive member insertion hole 63 is formed in the same manner as in Embodiment 1. This conductive member insertion hole 63 extends to the area close to the top end of the bristle-implanted part 71. The conductive member 7 placed on the handle 28 also extends longer than the conductive member 7 of Embodiment 1, in accordance with the conductive member insertion hole 63.

When a user uses this facial esthetic apparatus 70 having the above-described configuration to wash (or massage) his/her face with the sponge 72 and the brush bristles 73, or the sponge 74 by holding the handle 28, with his/her fingers touching the conductive plate 3A, the sponge 72, the brush bristles 73, and the sponge 74 become wet with liquids, such as water and facial cleanser, and form a liquid pathway, thereby causing the conductive member 7 to enter an electrically conductive state. This causes an electric current to pass through the route starting from the positive electrode of the power source 20, and through the conductive plate 3A, the user's hand, body, and face, the sponge 72 and the brush bristles 61 and the sponge 74 (liquid pathway), the conductive member 7, and the circuit formed on the substrate 18, and back to the negative electrode of the power source 20. The resultant electrical potential gradient can invigorate the bare skin, while washing the face. When this happens, the irregular pulse current is also generated from the facial esthetic apparatus 70 in the same manner as in Embodiment 1, and flickering of the light-emitting device 5 makes it possible to detect from the outside the state of generation of the irregular pulse current.

EMBODIMENT 4

A pulse-current generator according to Embodiment 4 is described below with reference to the relevant drawings. Components used in Embodiment 4 that are similar to those described in the aforementioned embodiments are given the same reference numerals as those in the aforementioned embodiments, and any detailed description thereof is omitted.

Figure 14:
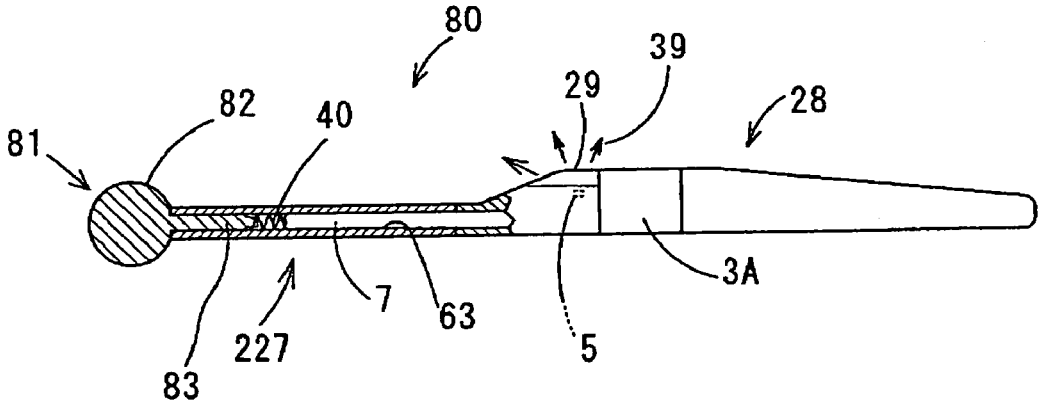
FIG. 14 is a partly sectional side view of a massager as a pulse-current generator according to Embodiment 4 of this invention.

FIG. 14 is a partly sectional side view of a massager as the pulse-current generator according to Embodiment 4.

As shown in FIG. 14, a major structural difference between a massager 80 of Embodiment 4 and the ion toothbrush 1 of Embodiment 1 is the configuration of the head 227. Inside the head 227, the conductive member insertion hole 63 is formed in the same manner as in Embodiment 1. This conductive member insertion hole 63 extends to the top end of the head 227.

A digital-pressure applying part 81 made of metal is attached to the top end of the head 227. This digital-pressure applying part 81 comprises: a spherical part 82; and a cylindrical spindle 83 connected to the spherical part 82. The spindle 83 is inserted into the conductive member insertion hole 63 and connected via a metallic spring 40 to the conductive member 7. The force applied by the spring 40 ensures that the conductive member 7 and the spindle 83 enter an electrically conductive state. FIG. 14 shows that the handle 28 and the head 227 are integrally formed, but the head 227 can be made in detachable form.

When a user uses this massager 80 having the above-described configuration to press the spherical part 82 of the digital-pressure applying part 81 against his/her skin by holding the handle 28, with his/her fingers touching the conductive plate 3A, an electric current passes through the route starting from the positive electrode of the power source 20, and through the conductive plate 3A, the user's hand and body, the digital-pressure applying part 81, the spring 40, the conductive member 7, and the circuit formed on the substrate 18, and back to the negative electrode of the power source 20. The resultant electrical potential gradient can invigorate the bare skin and achieve a good massage effect. When this happens, the irregular pulse current is also generated from the massager 80 in the same manner as in Embodiment 1, and flickering of the light-emitting device 5 makes it possible to detect from the outside the state of generation of the irregular pulse current.

EMBODIMENT 5

A pulse-current generator according to Embodiment 5 is described below with reference to the relevant drawings. Components used in Embodiment 5 that are similar to those described in the aforementioned embodiments are given the same reference numerals as those in the aforementioned embodiments, and any detailed description thereof is omitted.

Figure 15:
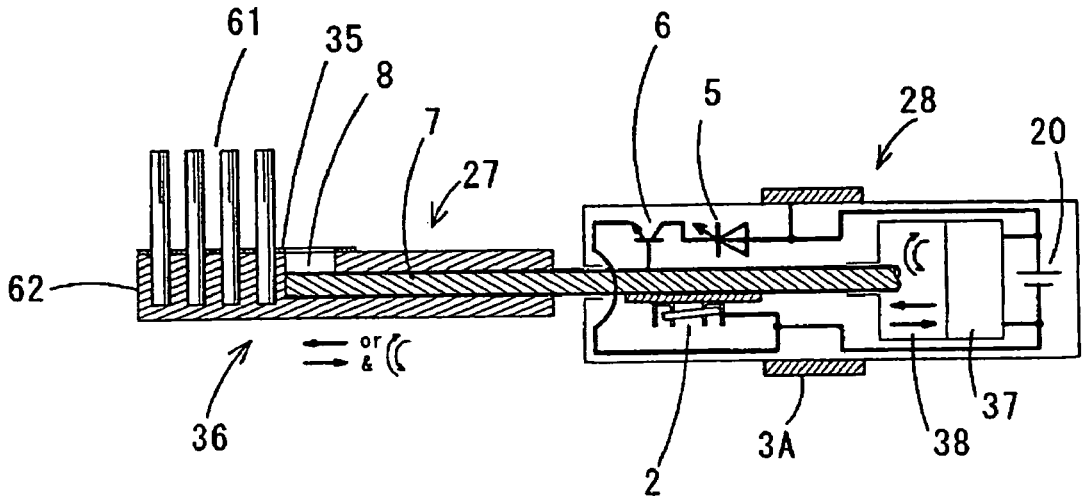
FIG. 15 is a schematic sectional view of an electric ion toothbrush as a pulse-current generator according to Embodiment 5 of this invention.

FIG. 15 is a schematic sectional view of an electric ion toothbrush as a pulse-current generator according to Embodiment 5.

As shown in FIG. 15, a main difference between an electric ion toothbrush 36 of Embodiment 5 and the ion toothbrush 1 of Embodiment 1 is that the head 27 automatically vibrates by electric power. Specifically speaking, the ion toothbrush 36 comprises: the power source 20, a motor 7, and a vibrator 38 driven by the motor 37 to vibrate the conductive member 7.

The vibrator 38 has both or one of the following functions: to cause reciprocating movement of the conductive member 7 along its axial direction; and to rotate the conductive member 7. It is desired that the conductive member 7 vibrates, for example, at approximately 3 to 10 Hz. The shaft center of the conductive member 7 may be inclined relative to the shaft center of the handle 28.

When the user uses the ion toothbrush 36 having the above-described configuration to brush his/her teeth, once he/she turns on a switch (not shown in the drawing) to make the conductive member 7 vibrate, the electric ion toothbrush 36 irregularly repeats the ON state and the OFF state of the contact-breaker device 2 in the same manner as in Embodiment 1, thereby supplying an irregular pulse current to the user.

Embodiment 5 has described a case where the head of the ion toothbrush vibrates. However, without limitation to this configuration, the head 127 of the facial esthetic apparatus 70 described in Embodiment 3, and the head 227 and the digital-pressure applying part 81 of the massager 80 described in Embodiment 4 may also vibrate.

EMBODIMENT 6

A contact-breaker device according to Embodiment 6 is described below with reference to the relevant drawings. Components used in Embodiment 6 that are similar to those described in the aforementioned embodiments are given the same reference numerals as those in the aforementioned embodiments, and any detailed description thereof is omitted.

Figure 16:
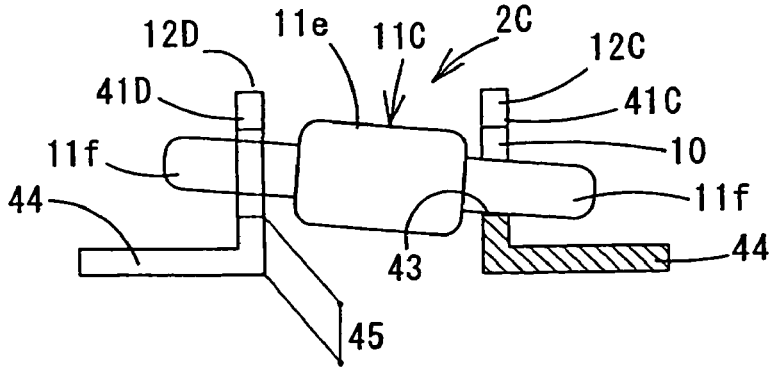
FIG. 16 is a partly sectional side view of a contact-breaker device according to Embodiment 6 of this invention as taken along line G-G in FIG. 17.
Figure 17:
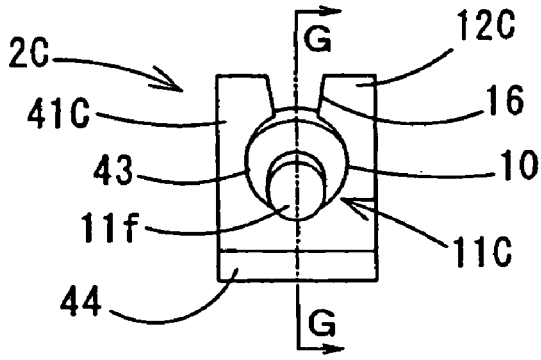
FIG. 17 is a right side view of the contact-breaker device shown in FIG. 16.

FIG. 16 is a partly sectional side view of the contact-breaker device according to Embodiment 6 as taken along line G-G in FIG. 17. FIG. 17 is a right side view of the contact-breaker device shown in FIG. 16.

As shown in FIGS. 16 and 17, a contact-breaker device 2C according to Embodiment 2 comprises: a pair of fixed terminals 12C and 12D secured on the substrate 18, which is a supporting member, at positions spaced apart from each other (see FIGS. 5 and 6); and a movable member 11C capable of moving relative to the pair of fixed terminals 12C and 12D and coming into or avoiding contact with the fixed terminals 12C and 12D based on its movement, thereby causing electrical conduction or insulation between the fixed terminals 12C and 12D.

Both the fixed terminals 12C and 12D are made of conductive materials similar to those of the fixed terminals 12A and 12B described in the aforementioned embodiments. Each fixed terminal 12C or 12D includes a side wall 41C or 41D (as third side walls recited in claims) installed upright on the substrate 18, and a fixed part 44 connected to the side wall 41C or 41D and secured on the substrate 18, and thereby has an L-shaped cross section. These fixed terminals 12C and 12D are placed so as to locate the side walls 41C and 41D opposite to each other. In the approximate midsection of each side wall 41C or 41D, the through-hole 10 of a diameter larger than that of the movable member 11C is formed. The movable member 11 loosely fits in the through-holes 10. Each side wall 41C or 41D also has the cutout 16, through which the movable member 11C may be inserted into the through-hole 10 in the same snap-fit manner as in the aforementioned embodiments. A distance (or height) 45 from the substrate 18 to the through-hole 10 is set so that neither of the ends 11f of the movable member 11C which fits in the through-holes 10 will touch the fixed parts 44.

The movable member 11C is made of conductive materials similar to those of the movable member 11 described in the aforementioned embodiments, and is substantially cylindrical. The length of the movable member 11 is longer than the distance between the side wall 41C of the fixed terminal 12C and the side wall 41D of the fixed terminal 12D. One end 11*f* of the movable member 11C loosely fits in the through-hole 10 of the fixed terminal 12C, while the other end 11*f* of the movable member 11C loosely fits in the through-hole 10 of the fixed terminal 12D. A flange 11*e* of larger diameter than that of the through-hole 10 is formed in the approximate center area of the movable member 11C (the area between the pair of fixed terminals 12C and 12D).

When the movable member 11C, which loosely fits in the through-holes 10, moves irregularly in response to externally applied vibration and thereby comes into contact with or moves away from the edges 43, which define the through-holes 10, and/or the side wall(s) 41C and/or 41D, the flange 11*e* touches the side wall(s) 41C and/or 41D and thereby restrains the movement of the movable member 11C. Therefore, the flange 11e has the role of preventing the movable member 11C from falling out through the through-holes 10. In addition, since the flange 11*e* can irregularly come into or avoid contact with the edges 43, it ensures that the pair of fixed terminals 12C and 12D and the movable member 11C are brought into electric conduction or insulation even more irregularly.

The movable member 11C can move in all directions in the same manner as the movable member 11 described above. Accordingly, it can make the above-described movement in response to vibration applied in any direction.

Since in the contact-breaker device 2C according to Embodiment 6 each fixed terminal 12C or 12D is generally L-shaped, it is possible to realize further miniaturization and reduction in weight compared to the U-shaped fixed terminals 12A and 12B as shown in FIG. 1.

EMBODIMENT 7

A contact-breaker device according to Embodiment 7 is described below with reference to the relevant drawings. Components used in Embodiment 7 that are similar to those described in the aforementioned embodiments are given the same reference numerals as those in the aforementioned embodiments, and any detailed description thereof is omitted.

Figure 18:
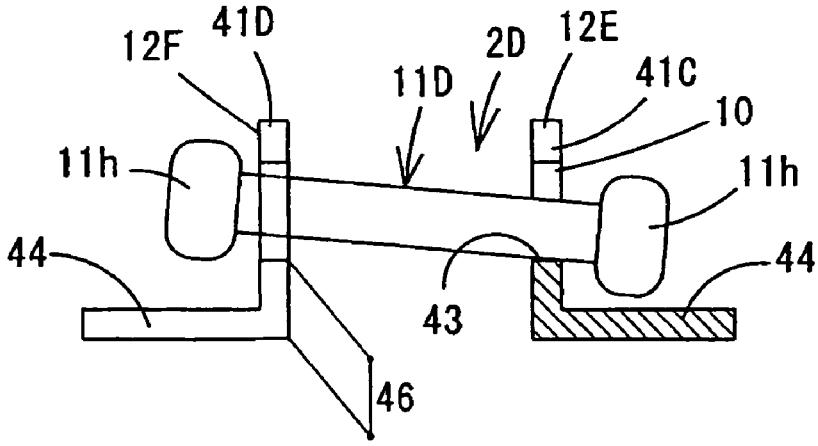
FIG. 18 is a partly sectional side view of a contact-breaker device according to Embodiment 7 of this invention as taken along a line identical to line G-G in FIG. 17.

FIG. 18 is a partly sectional side view of the contact-breaker device according to Embodiment 7 as taken along a line identical to line G-G in FIG. 17.

As shown in FIG. 18, main differences between a contact-breaker device 2D of Embodiment 7 and the contact-breaker device 2C of Embodiment 6 are the configuration of a movable member 11D and a distance (or height) 46 from the substrate 18 to the through-hole 10 of each fixed terminal 12E or 12F.

Regarding the movable member 11D of the contact-breaker device 2D according to Embodiment 7 as shown in FIG. 18, a flange 11*h* of larger diameter than that of the through-hole 10 is formed at both ends of the movable member 11D with its one end extending out through the through-hole 10 in the fixed terminal 12E and its other end extending out through the through-hole 10 in the fixed terminal 12F.

When the movable member 11D, which loosely fits in the through-holes 10, moves irregularly in response to externally applied vibration and thereby comes into contact with or moves away from the edges 43, which define the through-holes 10, and/or the side wall(s) 41C and/or 41D, both flanges 11*h* touch the side wall(s) 41C and/or 41D and thereby restrain the movement of the movable member 11D. Therefore, the flanges 11h have the role of preventing the movable member 11D from falling out through the through-holes 10. In addition, since the flanges 11*h* can irregularly come into or avoid contact with the edges 43, they ensure that the pair of fixed terminals 12C and 12D and the movable member 11D are brought into electric conduction or insulation even more irregularly.

Concerning the fixed terminals 12E and 12F, a distance (or height) 46 from the substrate 18 to the through-hole 10 is set so that neither of the flanges 11*h* at the ends of the movable member 11D which loosely fits in the through-holes 10 will touch the fixed parts 44.

The movable member 11D can move in all directions in the same manner as the movable member 11 described above. Accordingly, it can make the above-described movement in response to vibration applied in any direction.

EMBODIMENT 8

A case where a high-potential irregular pulse-current generating circuit according to Embodiment 8 is used in an ion toothbrush is described below with reference to the relevant drawings. Components used in Embodiment 8 that are similar to those described in the aforementioned embodiments are given the same reference numerals as those in the aforementioned embodiments, and any detailed description thereof is omitted.

Figure 19:
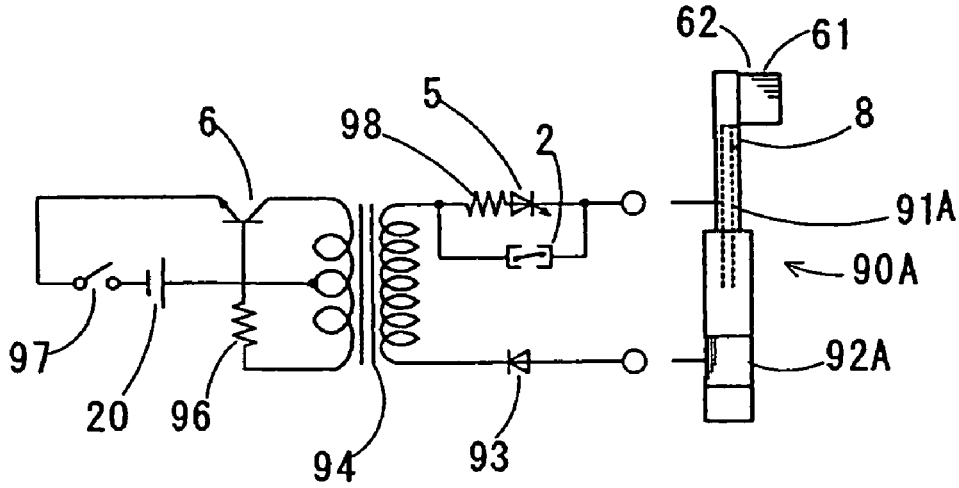
FIG. 19 illustrates a case where a high-potential irregular pulse-current generator according to Embodiment 8 is used in an ion toothbrush.

FIG. 19 illustrates a case where the high-potential irregular pulse-current generating circuit according to Embodiment 8 is used in an ion toothbrush.

In the high-potential irregular pulse-current generating circuit shown in FIG. 19, the primary side of an oscillation boosting transformer 94 is connected to the power source.20, the amplifying device 6, a current-limiting resistor 96, and a switch 97. On the other hand, the secondary side (or output side) of the oscillation boosting transformer 94 is connected to the contact-breaker device 2 and the light-emitting device 5 as the indicator, which are connected in parallel. The light-emitting device 5 is connected in series with a register 98 for obtaining the amount of current necessary to operate the light-emitting device 5 properly. Reference numeral 93 indicates a rectifier.

One output terminal of the high-potential irregular pulse-current generating circuit is connected to the conductive member 91A of an ion toothbrush 90A. Accordingly, the brush bristles 61 serve as one terminal of the contact electrode 3 described above. The other output terminal of the high-potential irregular pulse-current generating circuit is connected to conductive plate 92A. This conductive plate 92A serves as the other terminal of the aforementioned contact electrode 3. Since the ion toothbrush 90A is connected to the high-potential irregular pulse-current generating circuit, the ion toothbrush 90A becomes a high-potential toothbrush.

As in Embodiment 1, when the contact-breaker device 2 of the ion toothbrush 90A enters the ON state, the light-emitting device 5 does not operate and a pulse current of high voltage (for example, at approximately 200 V) is supplied only to the contact-breaker device 2, and then via the brush bristles 61 into the user's mouth. On the other hand, when the contact-breaker device 2 enters the OFF state, the light-emitting device 5 operates, the voltage decreases, and a pulse current of low voltage flows via the brush bristles 61 into the user's mouth.

Figure 20:
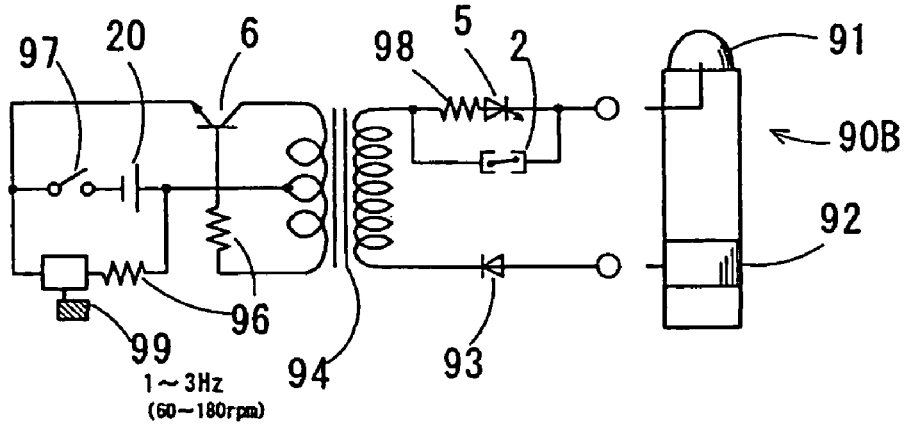
FIG. 20 illustrates a case where the high-potential irregular pulse-current generator according to Embodiment 8 is used in a massager.

In the high-potential irregular pulse-current generating circuit, a massager 90B may be used instead of the ion toothbrush 90A as shown in FIG. 20. Reference numeral 99 indicates a motor for applying vibration for massage to the massager 90B. The vibration of this motor 99 causes the contact-breaker device 2 to irregularly enter the ON state or the OFF state.

The top end of the massager 90B (the area to be in contact with the user's skin) is composed of a conductive member 91. A conductive plate 92 is placed around the part of the massager 90B to be held by the user. One output terminal of the high-potential irregular pulse-current generating circuit is connected to the conductive member 91. Accordingly, the conductive member 91 serves as one terminal of the aforementioned contact electrode 3. The other output terminal of the high-potential irregular pulse-current generating circuit is connected to the conductive plate 92. This conductive plate 92 serves as the other terminal of the aforementioned contact electrode 3.

Embodiment 8 has described a case where the contact-breaker device 2 is used in a high-potential irregular pulse-current generating circuit. However, without limitation to this configuration, the contact-breaker devices 2C, 2D, and 50 may be used.

We claim:

1. A pulse-current generator comprising:

a contact-breaker device comprising:

a pair of fixed terminals secured on a supporting member at positions spaced apart from each other, and a movable member capable of moving relative to the pair of fixed terminals and coming into or avoiding contact with the pair of fixed terminals based on its movement, thereby causing electrical conduction or insulation between the fixed terminals, wherein the movable member moves irregularly in accordance with externally applied vibration, thereby causing irregular electrical conduction or insulation between the fixed terminals;

a power source connected to the contact-breaker device to supply an electric current to the contact-breaker device;

a contact electrode for controlling the supply of the electric current to the contact-breaker device; and an indicator that operates based on an electric current supplied from the power source, wherein the contact electrode includes a pair of terminals spaced apart from each other; and when the pair of terminals comes into contact with a conductive object, the electric current is supplied to the contact-breaker device; and when at least either one of the pair of terminals moves away from the object, the supply of the electric current to the contact-breaker device is stopped, the contact-breaker device and the indicator are connected in parallel to the power source, and the indicator operates when a current path including the contact-breaker device is broken, and the indicator stops operating when the current path including the contact-breaker device is formed.

2. The pulse-current generator according to claim 1, wherein in the current path including the indicator, there is a control device for controlling the amount of electric current based on an electric potential difference between the contact-breaker device and the contact electrode.

3. The pulse-current generator according to claim 1, further comprising a driving member for vibrating either one of the terminals of the contact electrode.

4. The pulse-current generator according to claim 1, further comprising:

a bristle-implanted part with brush bristles implanted therein;

a handle for a user to hold, that contains the power source;

a conductive plate connected to one electrode of the power source and placed in a such a manner that at least part of the conductive plate is exposed on a surface of the handle; and a conductive member connected to the other electrode of the power source and capable of electrically connecting the brush bristles with the other electrode of the power source;

wherein one terminal of the contact electrode is composed of the conductive plate; and wherein the other terminal of the contact electrode is composed of the brush bristles.

5. The pulse-current generator according to claim 4, wherein the brush bristles and the conductive member are located at positions spaced apart from each other, and a liquid pathway is interposed between the brush bristles and the conductive member, thereby bringing the brush bristles and the conductive member into conduction via the liquid pathway.

6. The pulse-current generator according to claim 5, wherein a conductive connecting member connected to the liquid pathway is placed on at least part of the surface of the bristle-implanted part where the brush bristles are implanted.

7. The pulse-current generator according to claim 1, comprising a main body including a handle for a user to hold and a contact part that comes into contact with the user's body, wherein the main body contains the power source; and wherein one terminal of the contact electrode is composed of at least part of a surface of the handle, and the other terminal of the contact electrode is composed of at least part of a surface of the contact part.

* * * * *